US010107528B1

(12) United States Patent
Dodson

(10) Patent No.: US 10,107,528 B1
(45) Date of Patent: Oct. 23, 2018

(54) PULSE TUBE CRYOGENIC COOLER WITH TUNABLE INERTANCE TUBE

(71) Applicant: Christoper Star Dodson, Tijeras, NM (US)

(72) Inventor: Christoper Star Dodson, Tijeras, NM (US)

(73) Assignee: The United States of America As Represented By the Secretary of The Air Force, Washington, DC (US)

( * ) Notice: Subject to any disclaimer, the term of this patent is extended or adjusted under 35 U.S.C. 154(b) by 0 days.

(21) Appl. No.: 15/716,076

(22) Filed: Sep. 26, 2017

Related U.S. Application Data

(62) Division of application No. 14/802,995, filed on Jul. 17, 2015, now Pat. No. 9,784,480, which is a division of application No. 13/293,100, filed on Nov. 9, 2011, now Pat. No. 9,091,463.

(51) Int. Cl.
*F25B 9/14* (2006.01)

(52) U.S. Cl.
CPC ..... *F25B 9/145* (2013.01)

(58) Field of Classification Search
CPC ..... F25B 9/145; F25B 2309/1423; F25B 2309/1424
USPC ..... 62/6
See application file for complete search history.

(56) References Cited

U.S. PATENT DOCUMENTS

2008/0072608 A1* 3/2008 Rampersad ..... F25B 9/145 62/6

* cited by examiner

*Primary Examiner* — Ana M Vazquez
(74) *Attorney, Agent, or Firm* — James M. Skorish

(57) ABSTRACT

An inertance tube for a pulse tube cryogenic cooler which can be tuned to optimize performance. Apertures in the inertance tube fluidly communicate the inertance tube with a fluid reservoir. The effective length of the inertance tube is changed by alternatively closing or opening the apertures. Changing the effective length of the inertance tube causes a phase shift between the mass flow of and pressure waves in the enclosed working fluid which, in turn, changes the acoustic power. The cooling load capacity of the pulse tube cryogenic cooler is a function of the acoustic power. Controlling the phase angle improves the cooler's Carnot efficiency.

17 Claims, 4 Drawing Sheets

PULSE TUBE CRYOGENIC COOLER WITH TUNABLE INERTANCE TUBE

CROSS REFERENCE TO RELATED APPLICATIONS

This application is a division of pending U.S. patent application Ser. No. 14/802,995, filed on Jul. 17, 2015, which is a division of U.S. Pat. No. 9,091,463, filed on Nov. 9, 2011 and issued on Jul. 28, 2015, and claims the benefit of the foregoing filing date.

STATEMENT OF GOVERNMENT INTEREST

The conditions under which this invention was made are such as to entitle the Government of the United States under paragraph 1(a) of Executive Order 10096, as represented by the Secretary of the Air Force, to the entire right, title and interest therein, including foreign rights.

BACKGROUND OF THE INVENTION

Technical Field

The present disclosure relates generally to pulse tube refrigerators, including pulse tube cryogenic coolers, and more specifically to pulse tube refrigerators equipped with reservoirs and inertance tubes.

Background Art

Pulse Tube Refrigerators ("PTRs") play an important role in satisfying the need for cryogenic cooling of space-based infrared detectors as well as many other applications requiring coolers with high reliability, low vibration and high efficiency. PTRs employ three types of phase shifting processes to control the phase shift between the mass flow and pressure. The most conventional is used in Orifice Pulse Tube Refrigerators ("OPTRs"), wherein the mass flow and pressure are in phase at the orifice. In Double Inlet Pulse Tube Refrigerators ("DIPTRs"), a bypass valve between the warm end of the pulse tube and the warm end of the regenerator provides phase shifting. In Inertance Tube Pulse Tube Refrigerators ("ITPTRs"), which are the focus of this innovation, phase shifting is controlled by an inertance tube replacing the orifice.

BRIEF SUMMARY OF THE INVENTION

The following presents a simplified summary in order to provide a basic understanding of some aspects of the invention. This summary is not an extensive overview and is intended to neither identify key or critical elements nor delineate the scope of such aspects. Its purpose is to present some concepts of the described features in a simplified form as a prelude to the more detailed description that is presented later.

In accordance with one or more aspects and corresponding disclosure thereof, various aspects are described in connection with optimizing the performance of a PTR, and more particularly a pulse tube cryocooler, by changing the effective length of an inertance tube without changing its actual length. In one aspect, an apparatus is provided including a fluid reservoir containing a working fluid, typically a gas. A pulse tube's working gas is compressed and expanded to create a net heat flow. A pressure wave generator generates pressure waves within the working gas through the pulse tube.

An inertance tube has a proximal end in fluid communication with a hot heat exchanger which is, in turn, in fluid communication with the pulse tube; and a distal section which can fluidly communicate with a fluid reservoir through apertures along its length. The inertance tube and the reservoir cause a phase shift between pressure waves and mass flow in the working gas. A bypass mechanism selectably changes the state of each of the apertures from a selected one to the other of an open and a closed state.

In another aspect, a PTR comprises an electromechanical compressor disposed within a compressor housing. A regenerator is disposed in fluid-tight communication with the compressor and its aftercooler heat exchanger. A pulse tube has a proximal end in fluid-tight communication with a cold heat exchanger, with the latter also being in fluid-tight communication with the regenerator. An inertance tube has a proximal end in fluid-tight communication with a hot heat exchanger, with the latter also being in fluid-tight communication with the other, distal end of the pulse tube.

A fluid reservoir encompasses a distal section of the inertance tube, including the distal end and a plurality of apertures located along the length of the distal section. A sealing mechanism selectably closes the apertures or exposes apertures that were closed. The cold heat exchanger transfers heat from an external device requiring cooling to the pulse tube refrigerator. The hot heat exchanger removes heat from the pulse tube refrigerator.

In an additional aspect, a pulse tube refrigerator comprises a compressor for generating a pressure wave in a working gas within a cylinder. An aftercooler connected to the compressor sucks up and discharges working gas. The aftercooler removes the heat caused by the compression of the working gas sucked into or, alternatively, discharged from the compressor. A regenerator connected to the aftercooler stores the sensible heat of the working gas passing through the regenerator and returns the sensible heat when the working gas inversely passes through the regenerator. A cold heat exchanger is connected to one end of the regenerator. The cold heat exchanger transfers heat from an external device requiring cooling to the pulse tube refrigerator.

A pulse tube is connected to the other end of the cold heat exchanger for which the pulse tube acts as a gas piston which compresses and expands the working gas and creates a heat flow for the cold heat exchanger. A hot heat exchanger for emitting heat is fluidly connected to and located in between the pulse tube and a coiled inertance tube. The inertance tube shifts the phase between the pressure waves and mass flow. Apertures in the inertance tube fluidly communicate the inertance tube with a fluid reservoir. A tuning mechanism selectively seals a subset of the apertures to thereby control the effective length of the inertance tube.

To the accomplishment of the foregoing and related ends, one or more aspects comprise the features hereinafter fully described and particularly pointed out in the claims. The following description and the annexed drawings set forth in detail certain illustrative aspects and are indicative of but a few of the various ways in which the principles of the aspects may be employed. Other advantages and novel features will become apparent from the following detailed description when considered in conjunction with the drawings, and the disclosed aspects are intended to include all such aspects and their equivalents.

BRIEF DESCRIPTION OF THE DRAWINGS

The features, nature and advantages of the present disclosure will become more apparent from the detailed description set forth below when considered in conjunction with the following drawings, in which like reference characters identify correspondingly throughout.

DETAILED DESCRIPTION

Figure 1:
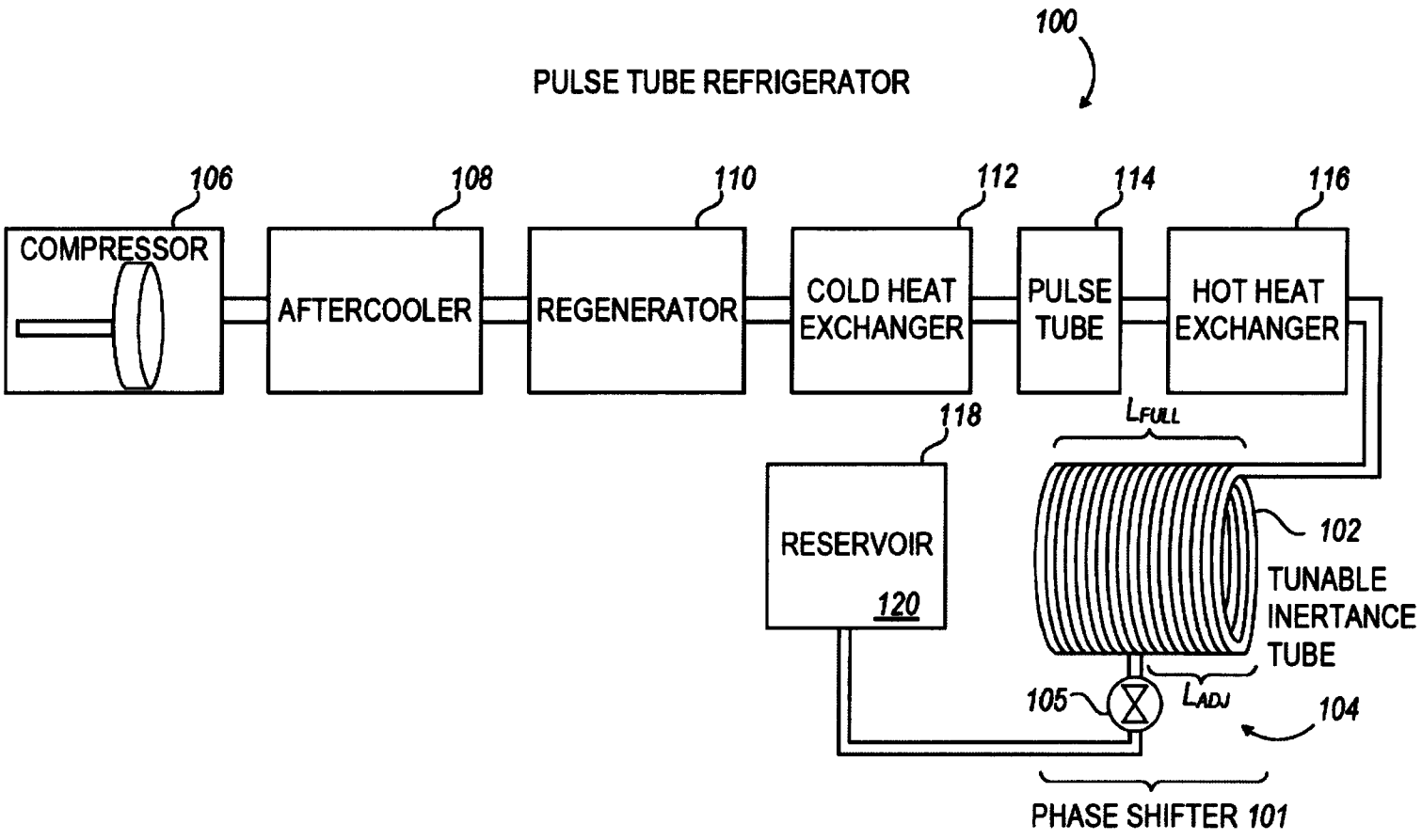
FIG. 1 is schematic diagram of a pulse tube refrigerator incorporating a tunable inertance tube.

The inertance tube component of a PTR can be used to improve the Carnot efficiency of such a refrigerator due to the inertance tube's ability to control phase shift better than earlier phase shifters, e.g., OPTRs and DIPTRs. A drawback to using a conventional inertance tube in a PTR is that such a tube is generally not able to vary its control of the phase shift between the mass flow and the pressure of the working fluid in the PTR, i.e., the phase shift is generally fixed once the inertance tube length is set. This invention provides a controllable length inertance tube and thus a controllable phase shift.

Phase shift is considered positive when mass flow leads pressure and negative when mass flow lags pressure. To minimize losses in the PTR, a zero phase shift is desired in the regenerator. To achieve the desired zero phase shift requires a negative phase shift on the cold side and a positive phase shift on the hot side of the regenerator. To realize a negative phase shift at the cold side of the regenerator requires a phase shifter capable of shifting the phases of both the mass flow and the pressure of the working fluid. It has been shown that earlier phase shifters were not capable of producing this negative phase shift. The tunable inertance tube of the present invention solves this problem by creating an inertial inductance component in the PTR capable of producing a negative phase shift at the cold side of the regenerator.

The tunable inertance tube of the present invention improves control of the phase shift by changing the effective length of the inertance tube, which affects the phase shift and acoustic power in the PTR. The acoustic power flow in the x direction, (which is the normal to a plane transverse to the fluid flow in a component of the PTR) is the power averaged over an integral number of cycles of the pressure, p, and the volume flow rate, V, and is mathematically described as the one-half the product of the respective magnitudes of the pressure and volume flow rate, times the phase shift between them, in accordance with the following equation:

$$\dot{E}(x) = \frac{\omega}{2\pi}\oint Re(p(x)e^{i\omega t})Re(V(x)e^{i\omega t})dt = \frac{1}{2}|p||V|\cos\phi_{pV}$$

Pursuant to the foregoing, the PTR designer can more easily tune a PTR to achieve the desired Carnot efficiency and load. Previous designs required time-consuming iterations to obtain the correct inertance tube length, whereas the present innovation allows the PTR designer to more quickly determine the optimal inertance tube length for the operating conditions of the PTR. Due to the complexity of oscillating flow in PTRs, tunable components are necessary to allow for quick modifications to be made during a PTR's operating life to compensate for changes in its performance characteristics.

Oscillating flow is complicated further by the lack of design equations that characterize such fluid flow parameters as friction, mass flow rate, and pressure. These parameters can be accurately calculated for steady flow in pipes, but not for oscillating flow. Design equation models to predict fluid flow parameters for inertance tubes include electrical analogies such as the lumped parameter model and the distributed model. The accuracy of these models is within experimental tolerance, but no models have yet been developed that can accurately characterize the oscillating flow in inertance tubes, although electrical analogies can be useful to approximately describe phase shifts and acoustic power.

Various aspects of the present invention are described herein with reference to the drawings. For purposes of explanation, numerous specific details are set forth in order to provide a thorough understanding of one or more aspects. It may be evident, however, that the various aspects may be practiced without these specific details. In other instances, well-known structures and devices are shown in schematic form in order to facilitate describing these aspects.

Turning to the drawings, FIG. 1 shows PTR 100 comprising a cryocooler utilizing phase shifter 101 depicted as tunable inertance tube 102 having a full length $L_{FULL}$ that can be adjusted to adjusted length $L_{ADJ}$ utilizing a bypass mechanism 104 which includes valve 105. The valve in this schematic is merely representative of the controller for the variable length inertance tube. This tunable length of inertance tube 102 is used to control acoustic power and phase shift in PTR 100. PTR 100 includes, in series, a pressure wave generator comprised of electromechanical compressor 106, e.g., a piston-type compressor, aftercooler 108, regenerator 110, cold heat exchanger 112, pulse tube 114, hot heat exchanger 116 and fluid reservoir 118. When in operation, PTR 100 is filled with working gas or liquid 120, such as helium.

Regenerator 110 acts as a thermal sponge, alternately absorbing heat from, and rejecting excess heat to, working gas 120 as the pressure waves travel back and forth. Regenerator 110 typically comprises a stack of screens. Packed spheres or parallel plates may also be used instead of stacked screens. Regenerator 110 has a large heat capacity compared with that of working gas 120. It has a low thermal conductivity to minimize conduction losses. The operating Carnot efficiency of PTR 100 depends partly on the Carnot efficiency of the heat transfer between regenerator 110 and working gas 120. Thus, where regenerator 110 comprises a stack of screens, the Carnot efficiency of regenerator 110 is determined by the screen mesh size, the materials used in fabricating the screens, and the phase shift between mass flow and pressure.

Pulse tube 114 is a thin-walled tube which has low thermal conductivity. The distal end of pulse tube 14 is in fluid-tight communication with hot heat exchanger 116 and then reservoir 118 via inertance tube 102. Reservoir 118 is an otherwise enclosed chamber. For example, reservoir 118 could enclose inertance tube 102.

Aftercooler 108, cold heat exchanger 112 and hot heat exchanger 116 are typically stacks of screens of high thermal conductivity, such as screens made of copper. Furthermore, the screens of the aforementioned components could thermally communicate with copper blocks, although any heat exchanger configuration could be used. Aftercooler 108 and hot heat exchanger 116 transfer or reject heat from PTR 100, e.g., to a heat sink, typically by heat conduction, heat pipe transport to a local radiator surface, or by use of a forced-flow coolant loop.

In operation, PTR 100 is filled with working gas 120. Compressor 106 generates pressure waves within working gas 120 at a predetermined frequency. Each pressure wave travels a portion of the length of PTR 100 and into reservoir 118. The interactions of working gas 120 with the geometry causes the pressure wave to change from one component to another, and may begin to phase shift, depending on the component. Thus, compressor 106 creates an oscillating pressure wave and acoustic power throughout PTR 100, with the amplitude and phase shift determined by the PTR components.

The compression of gas 120 initially increases its temperature to above that of the ambient temperature. However, the heat of compression is substantially removed by aftercooler 108. Thereafter, gas 120 is cooled to well below ambient temperature by expansion of gas 120 as it passes through regenerator 110. The alternating pressure waves generated by compressor 106 produce acoustic power which causes pulse tube 114 to act as a gas piston, where the net effect of the compression and expansion of this gas piston cools cold heat exchanger 112, and regenerator 110. The result of this heat pumping action is to lower the temperature of an external device requiring cooling (not shown) which thermally communicates with cold heat exchanger 112. Meanwhile, part of the acoustic power travels down pulse tube 114, where part of it is rejected as heat to a heat sink (not shown) by hot heat exchanger 116 and the remainder is available in inertance tube 102 and reservoir 118.

Figure 2:
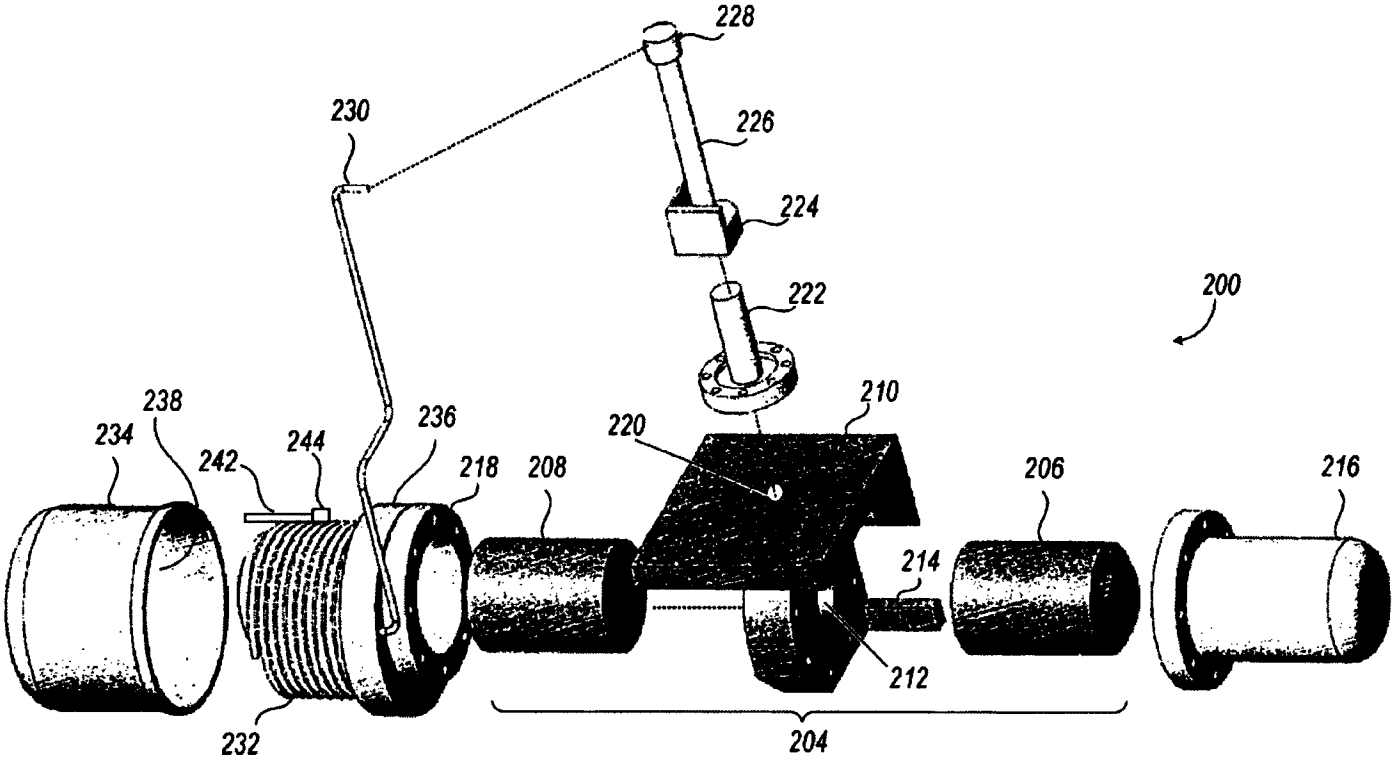
FIG. 2 comprises an exploded isometric view of a pulse tube refrigerator.

In FIG. 2, PTR 200 is an exemplary implementation of the present invention, and includes compressor 204 having first and second portions 206, 208 mounted to opposite sides of structural/thermal support 210 having aligned bore 212 through which pressure wave generator or piston 214 translates. Structural/thermal support 210 functions as an aftercooler to transfer heat from the working gas contained within PTR 200, generated by compressor 204, to a heat sink (not shown). First portion 206 is encompassed by first cylindrical compressor cover 216 mounted to the same side of structural/thermal support 210. Second portion 208 is encompassed by second cylindrical compressor cover 218 mounted to the same side of structural/thermal support 210, and lying opposite first cylindrical compressor cover 216.

Compressor covers 216, 218 form a fluid-tight cavity except for upper aperture 220 that fluidly communicates with the assembly of regenerator 222, cold heat exchanger 224, pulse tube 226 and hot heat exchanger 228. Inertance tube inlet 230 fluidly communicates hot heat exchanger 228 with inertance tube 232, which is coiled over and around second cylindrical compressor cover 218. Reservoir cover 234 encompasses coiled inertance tube 232 and seals to base ring 236 which in turn seals to second cylindrical compressor cover 218 to form fluid reservoir cavity ("reservoir") 238.

One or a plurality of apertures located along the length of inertance tube 232 fluidly communicates inertance tube 232 with reservoir 238. A bypass (tuning) mechanism comprised of closer assembly 242 closes or exposes the aperture or at least one of the apertures. In another aspect, sealing mechanism 244 can be actuated when closer assembly 242 needs to be moved to change the effective length of the inertance tube. Closer assembly 242, sealing mechanism 244, or both, can be passive, only requiring manually applied force for movement to create the sealing of the aperture or apertures, to thereby change the effective length of the inertance tube. Alternatively, active components can be incorporated for moving either closer assembly 242 or sealing mechanism 244, such as a reversible motor, for example, either a stepper motor or a controllable motor, connected to closer assembly 242 or sealing mechanism 244.

It should be appreciated with the benefit of the present disclosure that sealing mechanism 244 can be for one-time use or may be a mechanism capable of being repeatedly engaged. In addition, the one-time use can cause closer assembly 242 to change from a closed to an open position. Alternatively, the one-time use can cause closer assembly 242 to change from an open to a closed position. Furthermore, inertance tube 232 can be routed in other configurations other than a single layer coil as depicted. For instance, at least a portion of inertance tube 232 can be straight.

It should also be appreciated that various shaped cavities can be formed to form a reservoir that fluidly communicates with a distal section of an inertance tube, in particular with an aperture in the inertance tube. In addition, while tubing is depicted for clarity, it should be noted that an inertance tube can be a fluid passage formed in an otherwise solid material such as a manifold assembly.

Figure 3:
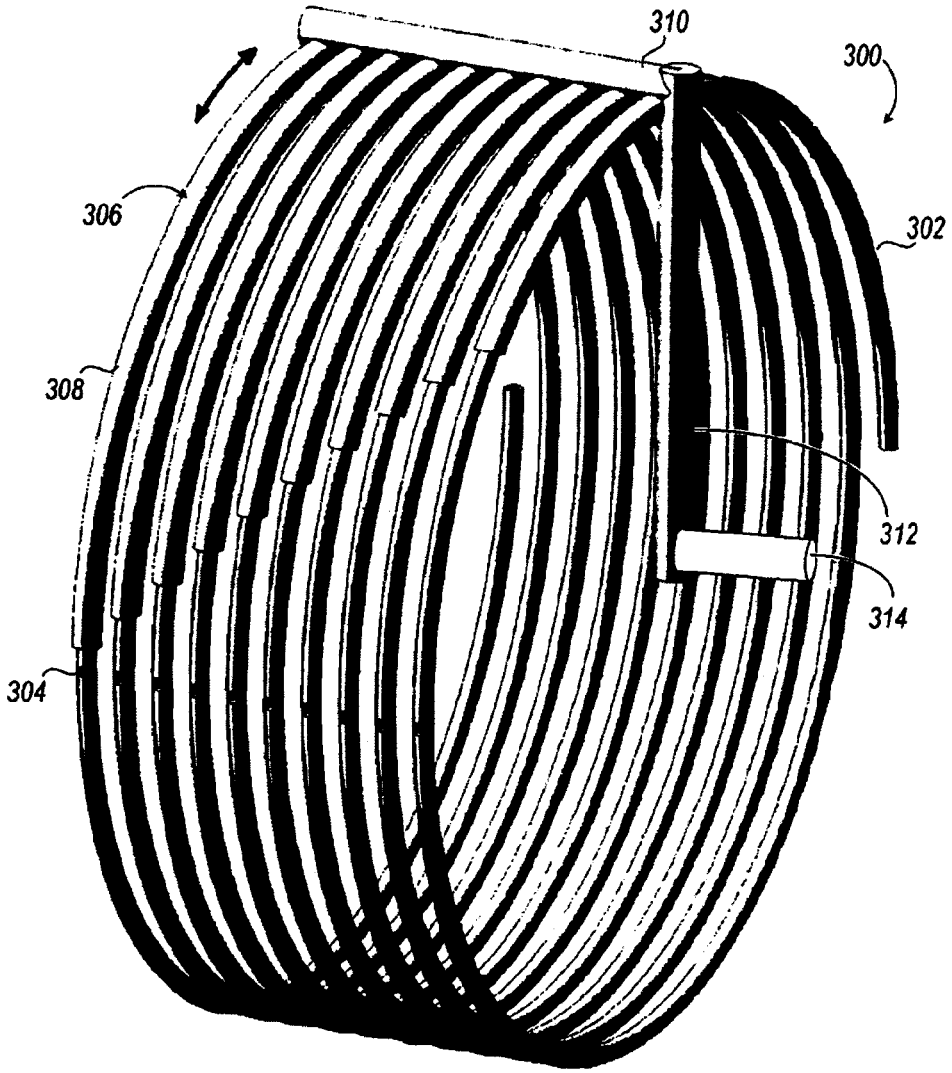
FIG. 3 comprises an isometric view of a first bypass mechanism for tuning a coiled inertance tube.

With reference to FIG. 3, in one illustrative aspect, tunable inertance tube 300 is shown for fluidly communicating with hot heat exchanger 228. Inertance tube 300 is spirally wound coil 302 lying inside of reservoir 238 (not shown in FIG. 3). Spirally wound inertance tube 302 includes machined holes 304 at various locations along its length. Any of holes 304 can then be sealed or covered to allow for the working gas to flow to the next hole 304. The effective length of the inertance tube can be changed by keeping previously covered holes 304 sealed and covering the next hole 304.

In some implementations, the working gas will attempt to escape to the next hole 304, and there can be turbulence losses due to the fluid flow past the covered hole 304 if not completely sealed. Thus the effective length is, in part, a function of the losses due to the turbulence created at each 'sealed' hole 304. Since inertance tube 302 is enclosed within reservoir 238, the working gas will flow out of inertance tube 302 and interact with the fluid flow in the reservoir.

Various structures or mechanisms may be used to cover, i.e., close, holes 304. Plugs or covers can be used to seal a hole while allowing the working gas to flow to the next hole. The plugs or covers can be either passively or actively maintained in the open or closed position. To minimize the amount of work to keep holes 304 open or closed, a passive design can be used. In the illustrative depiction, this can be achieved with slider mechanism 306 that closes the desired holes 304 by rotating around inertance tube 302 and creating an effective seal or actuating (closing) the seal assemblies (shown in FIG. 4).

For an integrated slider/seal assembly, a simple solution is to use a sleeve comprised of tubing 308 having an inner diameter that is slightly larger than the inertance tube's outer diameter. The integrated slider/seal assembly 306 allows for hole 304 to be covered by the slightly larger inner diameter of tubing 308 of integrated slider/seal assembly 306 while allowing other holes 304 to remain open. The slight gap between the outer diameter of inertance tube 302 and the inner diameter of tubing 308 should be minimized to allow the working gas in inertance tube 302 to flow to the next open hole 304 without significantly affecting fluid flow in inertance tube 302.

Armature 310 rotates integrated slider/seal assembly 306. More particularly, radial arm 312 is attached to externally accessible rotatable shaft 314, for rotating armature 310. For instance, a stepper motor (not shown) can selectively rotate shaft 314 and incorporate a locking feature.

Figure 4:
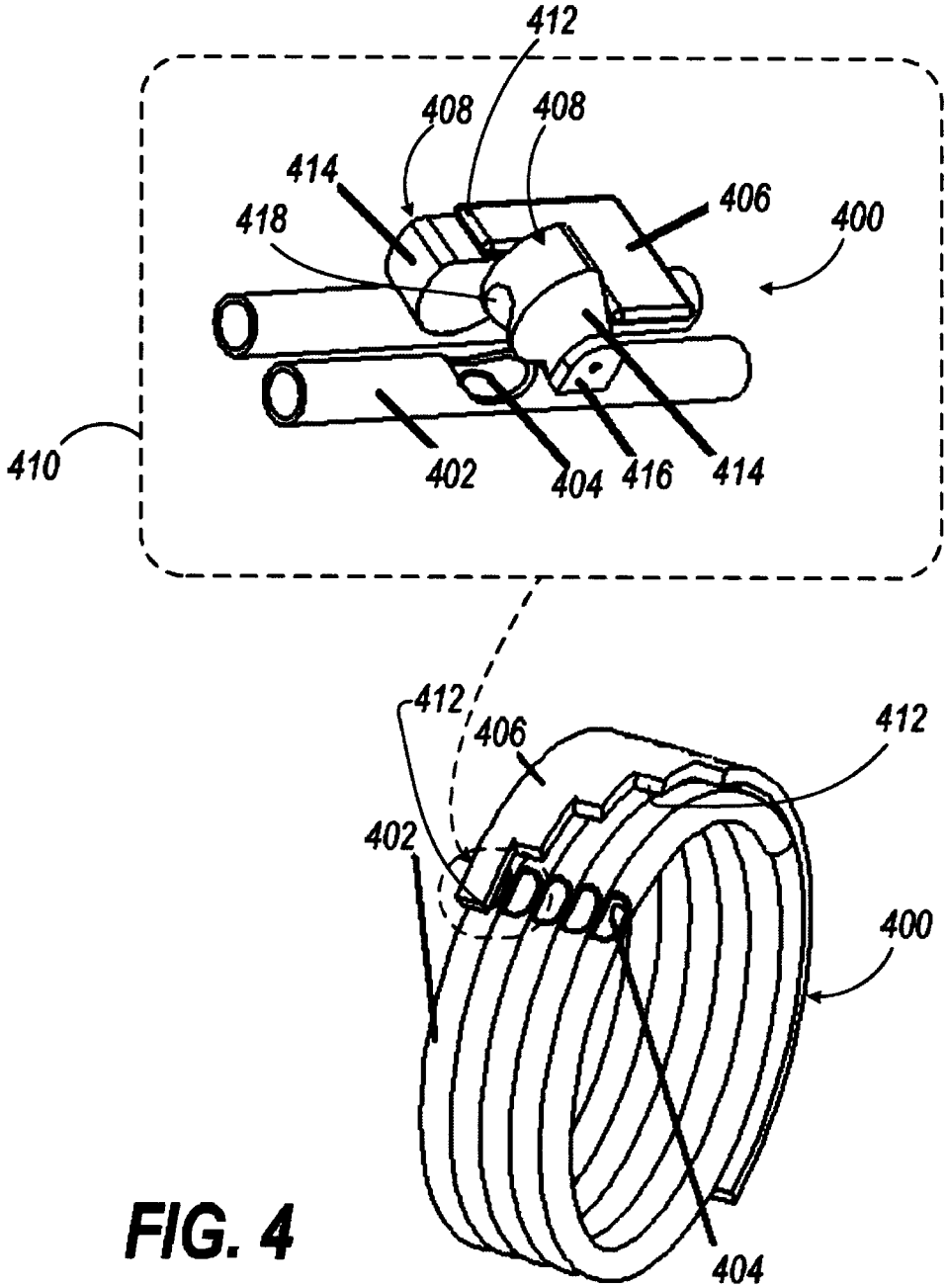
FIG. 4 comprises an isometric view of a second bypass mechanism for tuning a coiled inertance tube, including a detailed view of a seal assembly closed by a slider mechanism.

In FIG. 4, tunable inertance tube assembly 400 comprises coiled inertance tube 402 having laterally aligned holes 404 that can be selectably sealed with slider mechanism 406 that slides (rotates) over seal assembly 408 for each of holes 404, to open or close each of holes 404 and maintain each seal assembly 408 in the desired open or closed position. Seal assembly 408 can be a separate assembly from slider mechanism 406, with each of holes 404 being connected to a dedicated seal assembly 408, or seal assemblies 408 can be an integral part of slider mechanism 406. Each seal assembly 408 can seal one of holes 404 while allowing the fluid in inertance tube 402 to flow to the next hole 404. Slider mechanism 406 holds seal assembly 408 shut to close holes 404 that need to be closed while allowing for seal assemblies 408 at open holes 404 to remain open.

With particular reference to a detailed depiction at 410, staggered leading edge 412 of slider mechanism 406 contacts valve arm 414, which is pivotally attached between tabs 416 that are, in turn, fixedly attached to inertance tube 402. Rotation of slider mechanism 406 advances staggered leading edge 412 over one of valve arms 414 and thereby applies the force necessary to close the valve arm before sequentially reaching another valve arm 414 of another seal assembly 408. The shape of inwardly directed face 418 of valve arm 414 seals the respective hole 404 while being concave to avoid interfering with flow through the inertance tube 402. A flexible sealing material can be attached to either the tubing at holes 404 or seal assembly 408 to provide a better seal, created by the compressive force applied by leading edge 412. Springs (not shown) can be attached between valve arms 414 and tabs 416 to apply a spring force, to keep valve arms 414 in an open position when leading edge 412 is not over valve arms 414.

The word "exemplary" is used herein to mean serving as an example, instance, or illustration. Any aspect or design described herein as "exemplary" is not necessarily to be construed as preferred or advantageous over other aspects or designs.

The previous description of the disclosed aspects is provided to enable any person skilled in the art to make or use the present disclosure. Various modifications to these aspects will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

The invention claimed is:

1. A cryogenic cooler comprising:

a pressure generator for generating oscillating pressure waves in, and mass flow of, a contained working fluid;

an aftercooler fluidly communicating with the pressure generator, for transferring heat from the working fluid;

a regenerator fluidly communicating with the aftercooler, for absorbing heat from the working fluid flowing through the regenerator and storing absorbed heat, and for transferring stored heat to the working fluid;

a cold heat exchanger fluidly communicating with the regenerator, for transferring heat to the working fluid;

a pulse tube fluidly communicating with the cold heat exchanger, for compressing and expanding the working fluid and thereby creating heat flow in the working fluid;

a hot heat exchanger fluidly communicating with the pulse tube for transferring heat from the working fluid;

an inertance tube fluidly communicating a fluid reservoir with the hot heat exchanger and having an adjustable inductance, for causing a phase shift between the pressure waves and the mass flow;

a tuning mechanism for adjusting the adjustable inductance including:

an aperture having a state comprised of an open state for obtaining a maximum fluid communication between the inertance tube and the reservoir, or a closed state for reducing fluid communication between the inertance tube and the reservoir to a reduced fluid communication less than the maximum fluid communication;

a tubular sleeve slidable over the inertance tube and having a shaped leading edge; and the aperture having a sealing valve for changing the state of the aperture upon contact between the leading edge and the sealing valve, wherein the aperture remains in the open state in absence of contact between the sleeve and the sealing valve, whereby the cryogenic cooler has an improved Carnot efficiency.

2. The cryogenic cooler defined in claim 1 wherein:

the inertance tube has an outer diameter;

the sleeve has an inner diameter at least that of the outer diameter;

the sleeve being slidable over and enclosing at least a longitudinal section of the inertance tube which includes the aperture; and the sleeve being slidable over the aperture in a closing direction for changing the state of the aperture from the open state to the closed state, and for changing the state of the aperture from the closed state to the open state when sliding in an opening direction opposite the closing direction.

3. The cryogenic cooler defined in claim 1, wherein:

the inertance tube has a plurality of apertures; and the tuning mechanism is for sequentially changing respective states of the apertures.

4. The cryogenic cooler defined in claim 3, wherein the regenerator is for absorbing heat from the working fluid flowing through the regenerator in a first flow direction, and for transferring the stored heat to the working fluid when the working fluid flows through the regenerator in a second flow direction opposite the first flow direction.

5. The cryogenic cooler defined in claim 3, wherein the sealing valve is a plurality of sealing valves, and wherein the shaped leading edge is staggered to sequentially contact each of the sealing valves upon translation of the sleeve relative to the inertance tube.

6. The cryogenic cooler defined in claim 5, wherein:

the working fluid has a working fluid heat capacitance; and the regenerator has a heat capacitance greater than the working fluid heat capacitance.

7. The cryogenic cooler defined in claim 5, wherein the hot heat exchanger thermally communicates with a heat sink.

8. The cryogenic cooler defined in claim 3, wherein the inertance tube is a spirally wound coil.

9. The cryogenic cooler defined in claim 8 wherein:

the spirally wound coil has an axis of symmetry and an outer diameter;

the tuning mechanism is comprised of a plurality of sleeves, each of which has an inner diameter at least equal to the outer diameter;

the sleeves being jointly rotatable together about a common axis of rotation lying collinear with the axis of symmetry, and respectively subtending a common angle when rotated about the common axis; and the sleeves being slidable over and enclosing respective sections of the coil when rotated relative to the coil.

10. The cryogenic cooler defined in claim 9, wherein joint rotation of the sleeves about the axis of rotation relative to the spirally wound coil changes the state of at least one of the apertures.

11. The cryogenic cooler defined in claim 1, wherein the working fluid is a gas.

12. The cryogenic cooler defined in claim 1, wherein at least a section of the inertance tube lies within the reservoir.

13. The cryogenic cooler defined in claim 1 wherein:

the aperture is a plurality of apertures;

the inertance tube is comprised of a spirally wound coil having a plurality of parallel coil sections, with each coil section including at least one of the plurality of apertures;

the tubular sleeve is a plurality of tubular sleeves;

the tuning mechanism comprises the plurality of tubular sleeves lying in parallel to one another;

the sleeves rotate together about a common axis and respectively subtend a common angle when rotated about the common axis;

each of the sleeves is slidable over a coil section, respectively, when rotated about the common axis relative to the coil;

the sleeves being for sequentially changing respective states of the apertures from the open state to the closed state when the sleeves are rotated in a closing direction; and the sleeves being for sequentially changing the respective states of the apertures from the closed state to the open state when the sleeves are rotated in an opening direction opposite to the closing direction.

14. The cryogenic cooler defined in claim 13, further comprising an armature attached to the sleeves for rotating the sleeves in the closing and opening directions.

15. The cryogenic cooler defined in claim 13, wherein the working fluid is a gas.

16. The cryogenic cooler defined in claim 13, wherein at least one of the coil sections lies within the reservoir.

17. The cryogenic cooler defined in claim 16, wherein:

the working fluid has a working fluid heat capacitance; and the regenerator has a heat capacitance greater than the working fluid heat capacitance.

* * * * *